United States Patent [19]

Büchele

[11] Patent Number: 4,867,081

[45] Date of Patent: Sep. 19, 1989

[54] EMBROIDERY MACHINE DEVICE FOR ATTACHING RIBBONS ON A FABRIC BACKGROUND

[75] Inventor: Peter Büchele, Bregenz, Austria

[73] Assignee: Josef Hofer, Lustenau, Austria

[21] Appl. No.: 110,705

[22] PCT Filed: Nov. 29, 1986

[86] PCT No.: PCT/EP86/00692

§ 371 Date: Jul. 29, 1987

§ 102(e) Date: Jul. 29, 1987

[87] PCT Pub. No.: WO87/03628

PCT Pub. Date: Jun. 18, 1987

[30] Foreign Application Priority Data

Dec. 6, 1985 [AT] Austria ..... 3542/85

[51] Int. Cl.[4] ..... D05C 3/04

[52] U.S. Cl. ..... 112/83; 112/100

[58] Field of Search ..... 112/100, 83, 221, 236

[56] References Cited

U.S. PATENT DOCUMENTS

| | | | |
|---|---|---|---|
| 4,513,672 | 4/1985 | Tajima | 112/100 |
| 4,535,709 | 8/1985 | Kuhnis | 112/83 |
| 4,543,897 | 10/1985 | Heinzle | 112/221 |
| 4,577,569 | 3/1986 | Okugawa | 112/83 |

FOREIGN PATENT DOCUMENTS

| | | |
|---|---|---|
| 76482 | 5/1893 | Fed. Rep. of Germany . |
| 5429 | 7/1892 | Switzerland . |

*Primary Examiner*—Andrew M. Falik

*Attorney, Agent, or Firm*—Toren, McGeady & Associates

[57] ABSTRACT

A device for embroidery machines for attaching ribbons, braid, or the like on a fabric background has an axially displaceable rod-like needle carrier with a needle for embroidery thread. A material pressure foot is swivelable around the axis of a needle bar. A shuttle for receiving a shuttle thread is arranged behind the fabric background. The needle bar is received by a hollow shaft which is rotatable relative thereto. A front face of the hollow shaft includes radially extending grooves which are arranged diametrically with respect to each other. Webs extending into the radially extending grooves are provided at the rear side of an annular disk-shaped retainer for the material pressure foot. The needle of the needle bar extends into the retainer and is connected to a lifting mechanism of the material pressure foot. At least a front segment of the hollow shaft is received by a sleeve which is rotatable with respect to the hollow shaft. The inside wall of the sleeve has at opposite regions circumferentially extending, sickle-like recesses. The radial extensions of the recesses are directed in opposite directions. The distance between the outer flanks of the webs is somewhat smaller than the sum of the external diameter of the segment of the hollow shaft with the grooves and of the largest radial extension of a sickle-like recess.

12 Claims, 4 Drawing Sheets

EMBROIDERY MACHINE DEVICE FOR ATTACHING RIBBONS ON A FABRIC BACKGROUND

BACKGROUND OF THE INVENTION

1. Field of the Invention

The invention is directed to a device for embroidery machines for attachment of ribbons, braids or the like on a fabric background. The device includes an axially displaceable bar-like needle carrier with a needle for the embroidery or sewing thread, and a fabric pressure foot, through which runs the ribbon or the like to be applied and which is swivelable around the axis of a needle carrier. A shuttle is arranged behind the fabric background for receiving the shuttle- or tie-up thread.

2. Description of the Prior Art

The ribbons, laces, gimp yarn or braid are attached to a fabric background or embroidery base with devices of this type, wherein it is typical that this fancy material lies only on top of the embroidery base and is only fastened with same by sewing- or warp stitches. This type of shaping a fabric background or embroidery base is called soutache embroidery and installations of the above-mentioned type can be attached at embroidery machines. The fancy material is fastened to the embroidery base at short intervals by the needle- and shuttle thread and the threads used herein are so thin that they can be hardly seen in the finished product. Spectacular embroideries can be produced with this technology. In conventional soutache apparatus utilized in connection with embroidery machines, the fabric pressure foot serving as thread guide for the fancy material can be pivoted around the needle only by a moderate amount, which considerably limits the pattern possibilities, since this guide for the fancy material can only be swiveled so far that one has the assurance of avoiding that the ribbon- shaped or braid-shaped fancy material twists and winds itself up in a manner that it can no longer be applied satisfactorily.

It is, therefore, the aim of the invention to further develop and perfect these known devices. Particularly, the limited choice of patterns in the known devices because of the limited swivelling of the fabric pressure foot serving as a guide for the fancy material is to be completley eliminated.

SUMMARY OF THE INVENTION

The solution of this task is achieved in the invention, in that the needle carrier or needle bar is housed in a hollow shaft rotatable with respect to the needle bar. Also the front side of this hollow shaft facing the material background or the embroidery plane comprises radially extending grooves arranged diametrically with respect to each other. Webs which are provided at the rear side of an annular disk-shaped retainer for the material pressure foot engage in the grooves. The retainer is penetrated by the needle or the needle bar and is connected with the lifting mechanism for the material pressure foot. At least the front side segment of the hollow shaft is received by a bushing rotatable relative to the hollow shaft. The inside wall of the bushing comprises recesses extending in circumferential direction and extending sickle-like at opposite regions, the radial extent of the recesses facing in opposite directions. The distance between the external flanks of the webs is somewhat smaller than the sum of the external diameter of the segment of the hollow shaft comprising the grooves and the largest radial extent of a sickle-like recess.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE PREFERRED EMBODIMENT

Figure 12:
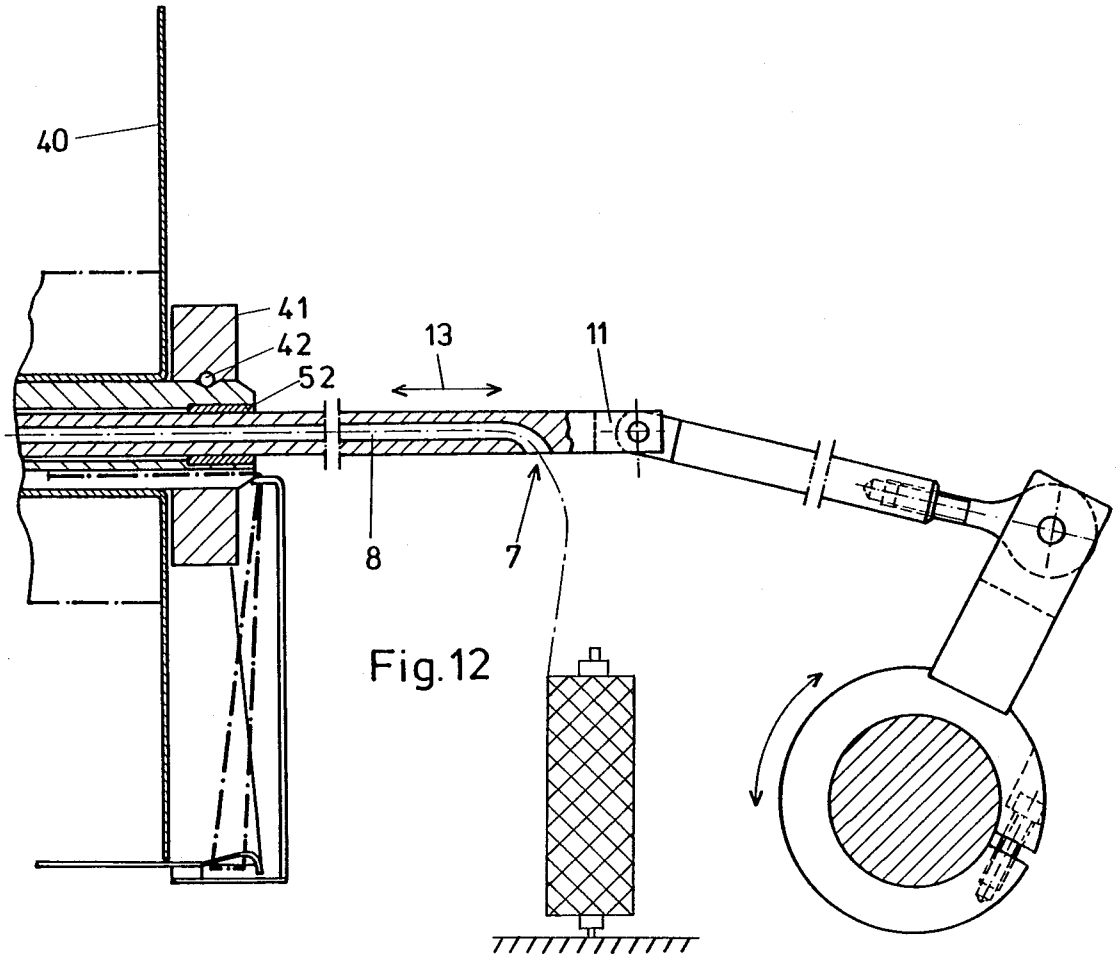
FIG. 12 is a partially sectional view of a drive for a needle bar of the device.

Bearing blocks 2 and 3 are provided on a machine stand of an embroidery machine, particularly on a base line 1 extending parallel to the embroidery plane E, which support a hollow shaft 4, whose axis is at right angles with respect to the embroidery plane E. This hollow shaft 4 has a channel or groove 5 open on the edges and accepts in its inner hollow space 6 a bar-shaped needle carrier 7, which on its part has a centrally running channel or longitudinal bore 8. On its one end the needle carrier 7 carries the sewing needle 10, on its other end the needle carrier is connected with the actuating mechanism (FIG. 12) of the embroidery machine, by which the needle carrier 7 is periodically moved to and fro. The hollow shaft 4 is supported to be rotatable with respect to the needle bar 7. In order to initiate such a rotational movement of the hollow shaft 4, one utilizes the pinion 12 connected with the shaft and fastened on same. A ball bearing 14 is provided between the bearing block 3 and hollow shaft 4; an additional bearing 52 exists between the needle carrier and the hollow shaft 4.

The front side of the hollow shaft 4 facing the embroidery plane E is received in a bushing or sleeve 15, which is rotatable with respect to the hollow shaft 4 and the bearing block 2 by interposed roller bearings 16 and 18. In order to initiate such a rotational movement of the bushing it is fixedly connected with a pinion 17.

The hollow shaft 4 centrally penetrated by the needle carrier 7 has two grooves 19 at the side facing the embroidery plane E, which are arranged diametrically opposite each other and which extend radially. The bushing 15 which overlaps the segment of the hollow shaft 4 provided with the grooves 19, comprises sickle-like extending recesses 20 at opposite regions of the inside wall, which extend in circumferential direction and whose radial extents are designed in opposite directions to each other. The bushing 15 is rotatable with respect to the hollow shaft 4 (arrow 21—FIGS. 6,7,8), so that, depending upon the relative positions of the two mentioned parts to each other, differently spaced wall segments of the sickle-shaped recesses 20 lie respectively opposite to the grooves 19 of the hollow shaft 4.

Figure 4:
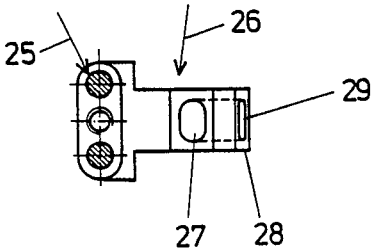
FIG. 4 is a plan view of the material pressure foot taken along sectional line IV—IV of FIG. 3.

Webs 22 engage into these grooves 19 of the hollow shaft 4, which are arranged at the rear side of an annular disk-shaped retainer 23. This annular disk-shaped retainer 23 has a cutout 24 located approximately in its middle, and carries at its front side by means of the web 25 the material pressure foot 26 proper with an elongated central bore 27 (FIG. 4) for the passage of the needle 10, and this material pressure foot has also a leg 28, which is facing away from the embroidery plane E and extends obliquely with respect to same. This leg 28 is equipped with an additional bore 29, which discharges into the central bore 27 intended for the needle 10.

The annular disk-shaped retainer 23 or its outer edge lies in a groove 30, which is provided at the inner side of a support ring 31. There is so much clearance between this groove 30 and the edge of the retainer 23 received by it, that this retainer 23 is freely movable in its plane within the support ring 31. This support 31 is connected with a carriage 32, which is displaceable at right angles to the embroidery plane E by the material pressure shaft 33 or pressure foot lifting mechanism in the rhythm of the needle movement 10. For this purpose the material pressure shaft 33 has a radially projecting web 34 with a bore 35 provided on one end. A pin 36 is solidly connected with the carriage 32, which penetrate the mentioned bore 35 and is mechanically coupled with the web 34 by means of a spring 37. The shuttle path 38 is arranged in the usual manner behind the embroidery plane E.

Figure 6:
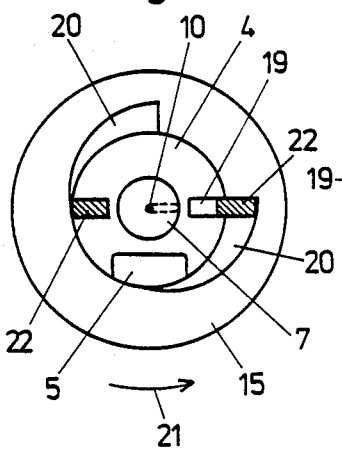
FIGS. 6, 7 and 8 are front views of the front side of a hollow shaft and of a bushing of the device according to the invention in various relative position with respect to each other, taken along sectional line VI—VI in FIG. 1.
Figure 7:
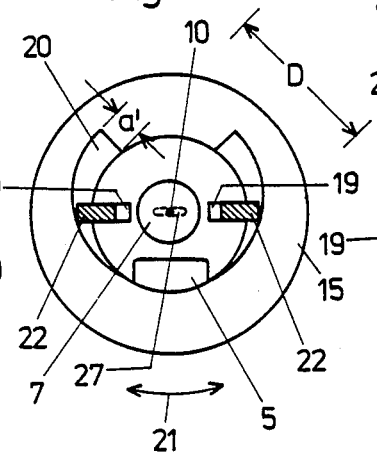
Figure 8:
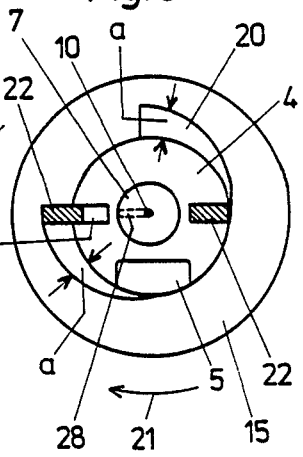
Figure 2:
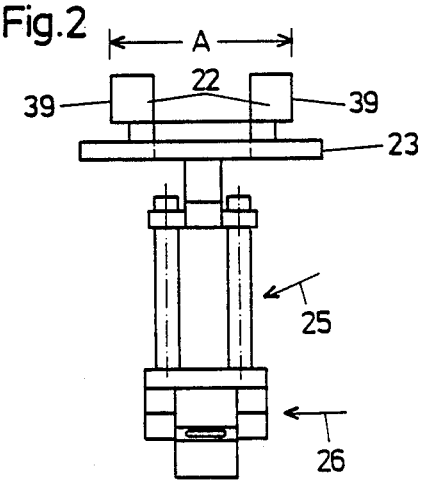
FIG. 2 is a front view, partly in section, of the material pressure foot of the device of the present invention.
Figure 3:
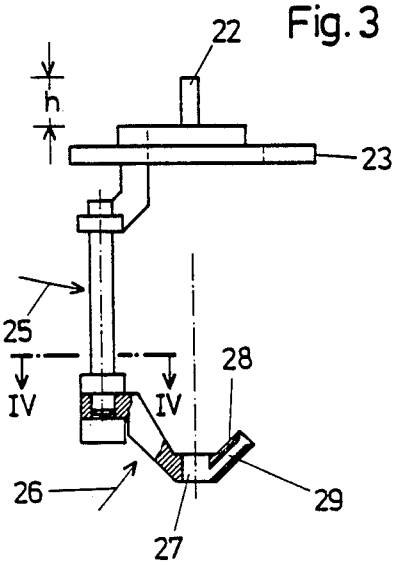
FIG. 3 is a side view, partly in section, of the material pressure foot of the device of the present invention.
Figure 5:
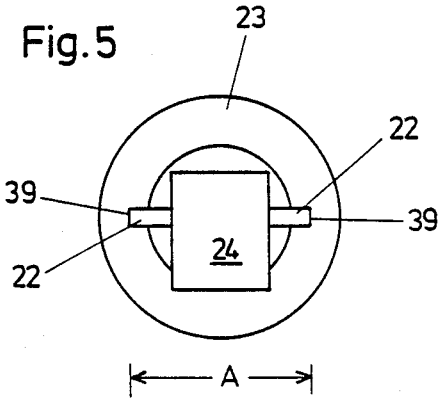
FIG. 5 is a rear view of an annular disk-shaped retainer for the material pressure foot.

The webs 22 at the rear side of the annular-shaped retainer 23 are designed and dimensioned in such a way that the distance A between the outer flanks 39 of these webs 22 is somewhat smaller than the sum of the external diameter D of the segment of the hollow shaft 4 comprising the grooves 19 and the greatest radial extent a' of a sickle-like recess 20 of the bushing 15 (FIG. 6 and 8). The height h of the webs 22 is furthermore so dimensioned that these webs 22 protrude to a larger extent into the grooves 19, than would correspond to the lifting weight of the material pressure foot 26 in actual operation.

The hollow shaft 4 projects with its side facing away from the embroidery plane E freely beyond the base line 1 and carries on this projecting segment a storage bobbin 40 freely rotatable with respect to the hollow shaft 4, upon which the fancy material is coiled. A locking member 41 retained by a detent 42 is pushed over the end of the hollow shaft and secures the axial position of the mentioned storage bobbin 40 for the fancy material.

Figure 1:
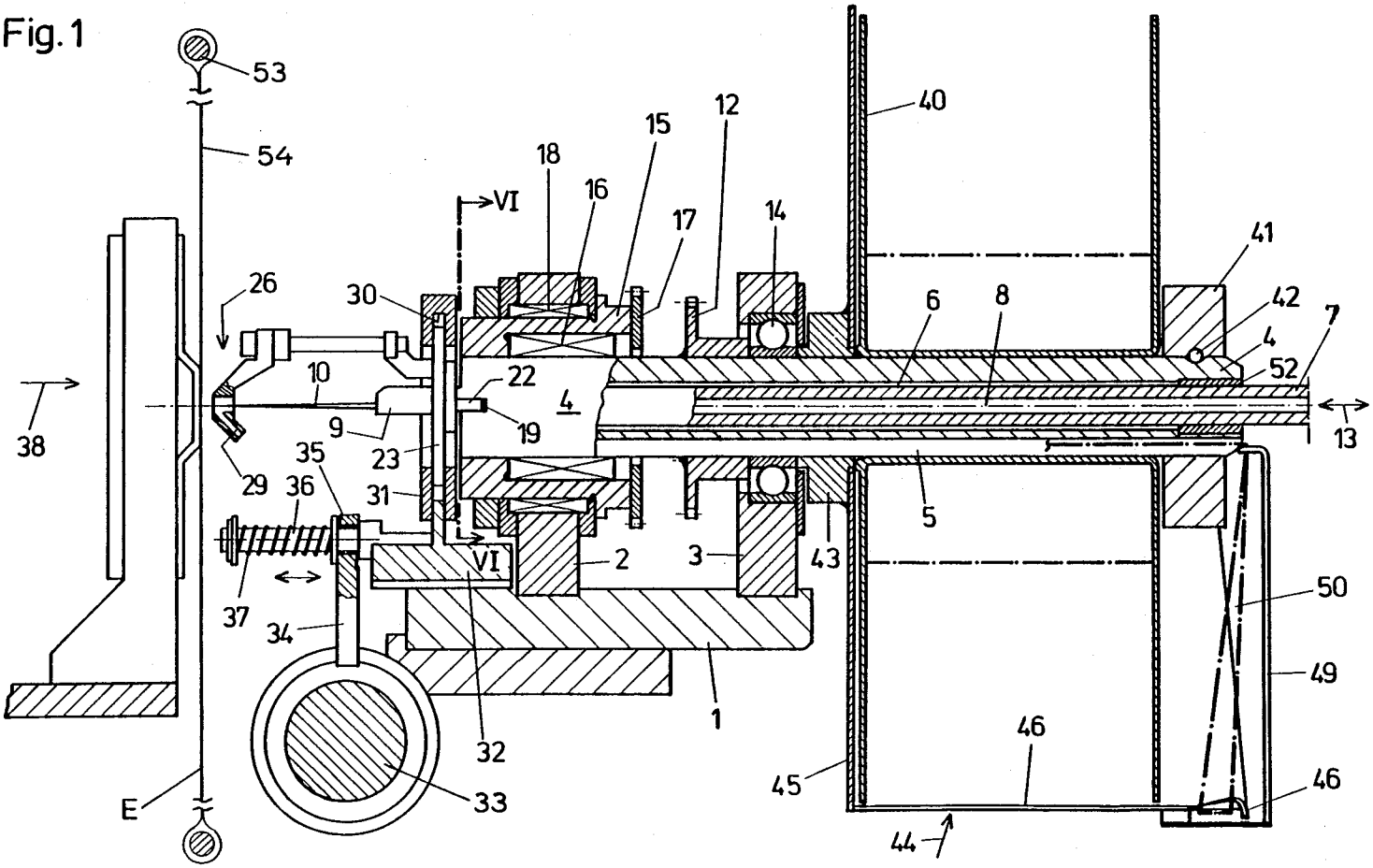
FIG. 1 is a longitudinal cross-sectional view of the device according to the present invention.
Figure 11:
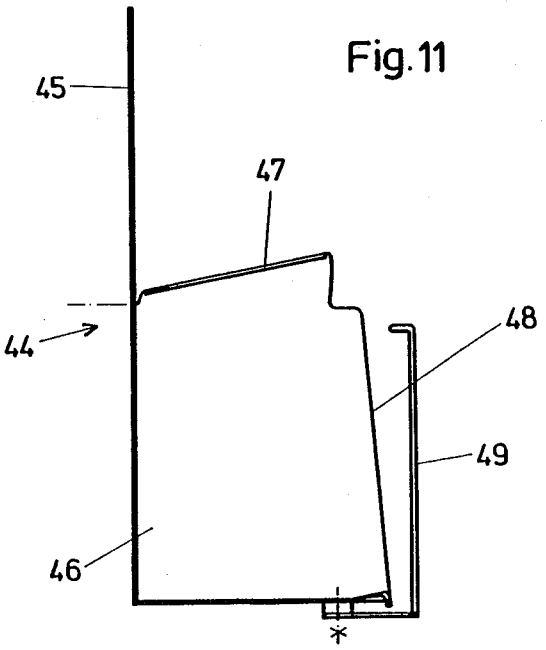
FIGS. 9, 10 and 11 are a front view, a side view and a plan view, respectively, of a guide member for fancy materials.
Figure 9:
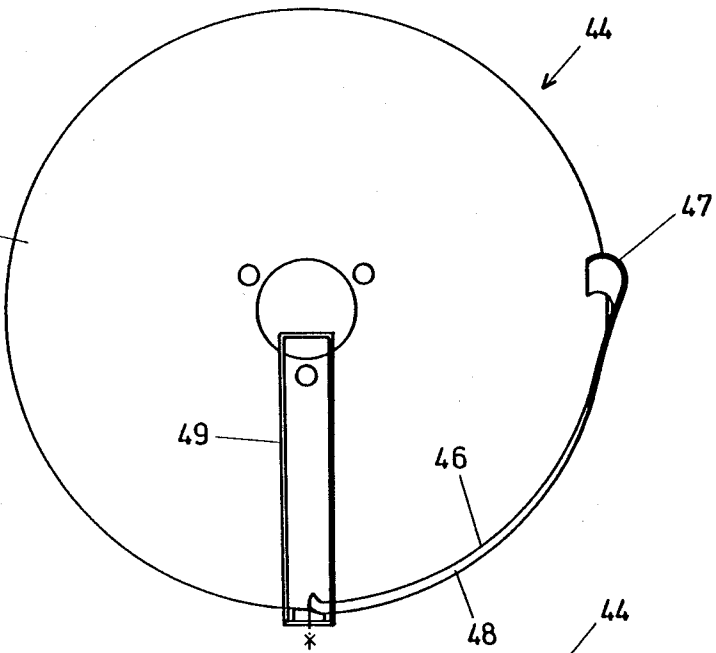
Figure 10:
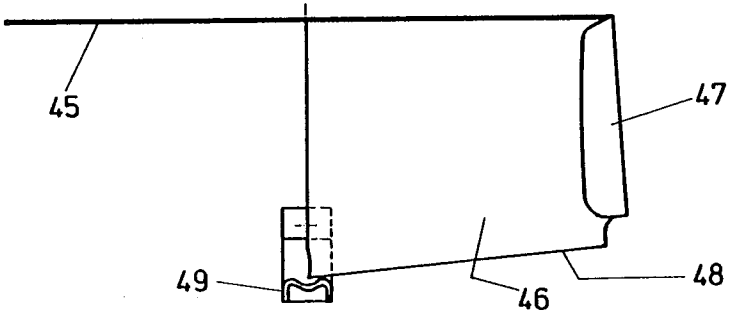

A ribbon guide member 44 is solidly connected with the hollow shaft 4 by means of a sleeve 43 on the left hand side of the bobbin 40 (referred to FIG. 1). This ribbon guide member 44 is depicted in different views in FIGS. 9 to 11. It comprises a disk 45 which is solidly connected with the mentioned sleeve 43, for instance it is bolted with same. A superimposed strip 46 projects beyond the bobbin 40 over a portion of the circumference of this disk 45, in this case for instance over 90°, and this superimposed strip 46 comprises an arched and obliquely extending run-up edge 47. The free longitudinal edge 48 of the superimposed strip 46 is somewhat edged upwards and at the free corner of the superimposed strip 46 facing away from the run-up edge 47 a wire bracket 49 oriented radially with respect to the disk 45 is arranged to be detachable from strip 46. It should be observed here that the superimposed strip 46 does not necessarily have to be connected with a disk 45. The superimposed strip 46 can also be connected in another suitable manner with the hollow shaft 4 or the sleeve 43.

The pinions or drive wheels 12 and 17 of the hollow shaft 4 and of the bushing 15 are connected with a drive by transmission means for instance by chains, wherein this drive is designed in such a manner that the drive pinions 12 and 17 can be driven synchronously or that the drive pinions 12 and 17 can be displaced angularly with respect to each other during the driving operation in actual operation.

The operation of the device discussed above will now be explained: The sewing thread is led from a storage bobbin, not depicted here, through the central channel 8 of the needle carrier 7 and through the central cutout 24 of the annularly shaped retainer 23 to the needle 10 and is threaded into said needle; the sewing thread serves for attaching the fancy material to the embroidery base. The for instance ribbon-shaped fancy material 50 is coiled on the bobbin 40 and is led from there by the superimposed strip 46 and the wire bracket 49 to the channel 5 of the hollow shaft 4 and is conducted through same and also through the cutout 24 of the retainer 23 and is then threaded into the bore 29 of the inclined leg of the material pressure foot 26. An embroidery frame 43 and base 53 is stretched in the embroidery plane E. By the a reciprocal motion of the embroidery base in the embroidery plane E controlled in accordance with a pattern, the sewing thread as well as the fancy material are pulled off from their storage bobbins.

Figure 13:
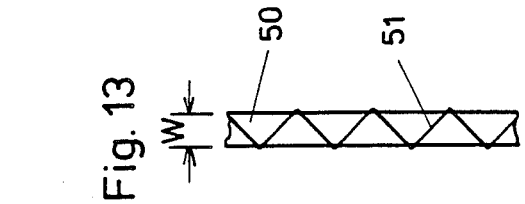
FIGS. 13 and 14 schematically show the attachment of the fancy material.

If one assumes that the fancy material is at first laid in straight line from the top towards the bottom, then the needle 10 performs its periodic movement to and fro (Arrow 13), during which time the hollow shaft 4 is out of action, thus not being rotated. However, during this motion of the needle carrier the pinion 17 of the bushing 15 is moved to and fro in the same rhythm as the needle carrier, so that this bushing 15 periodically assumes the positions with respect to the immobilized hollow shaft 4 discernible from the FIGS. 6 to 8. This reciprocating motion (Arrow 21) of the bushing 15 with respect to the at first immobilized hollow shaft 4 causes the webs 22 and with them the annularly-shaped retainer 23 and with same the material pressure foot 26 to be moved to and fro by the flanks of the sickle-shaped recesses 20, so that the needle 10 continuously changes its relative position within the central bore 28 of the material pressure foot 26 and thus the needle 10 plunges into the embroidery base in the embroidery plane E forming stitches on alternative sides of the fancy material. The periodically changing position between needle 10 and bore 27 in the material pressure foot 26 is discernible from FIGS. 6, 7 and 8. The sewing thread 51 is thus stretched and pulled across the fancy material 50 in zig-zag sequence or shape having a width W (FIG. 13). The to and fro movement of the material pressure foot 26 is followed also by the embroidery frame or a reel carrying the embroidery base, wherein the embroidery frame is synchronously controlled with the material pressure foot, so that the fancy material 50 runs straight between individual stitches.

Figure 14:
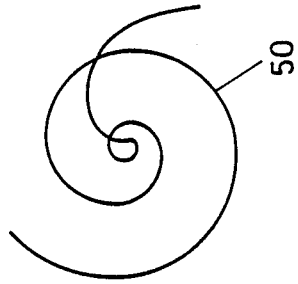

It is however also possible to place the fancy material 50 in accordance with the pattern in arcs and spirals (FIG. 14). In such cases the hollow shaft 4 is either driven so that the hollow shaft 4 can either periodically move to and fro or continuously rotate in the same direction. With the rotating hollow shaft 4 the ribbon guide member 45 also moves and the material pressure foot 26 synchronously with it, so that during such a continuous rotational movement in one direction, the hollow shaft 4, the ribbon guide member 44 and the material pressure foot 26 retain their relative position with respect to each other. Depending upon the type and property of the fancy material, the material pressure foot performs the previously described periodic reciprocating motion. The extent of the sideways offset of this motion (FIGS. 6 to 8) depends upon the respective extent of the relative displacement of the bushing 15 with respect to the hollow shaft 4. The appropriate control magnitudes and control values are programmable and depend on the type of the pattern and on the type and the properties of the material (fancy material) to be processed. In this case also the embroidery frame is controlled synchronously.

If a fancy material is to be punctured by the sewing needle and penetrated by the sewing threads, then the hollow shaft 4 and the sleeve or bushing 15 are driven synchronously, so that these two parts do not execute a relative movement with respect to each other and the material pressure foot 26 retains its position with respect to the hollow shaft independently of its respective angular position.

It is possible with the proposed design to have the material pressure foot 26 revolve practically continuously in one or the other rotational direction, so that the fancy material, even if it is present in ribbon form, can be laid in numerous spirals and circles, without there being the danger that the material becomes wound up or twisted in one direction by the continuous rotational movement of the material pressure foot 26 and becomes unsuitable for application.

In a practical embodiment form of the invention devices of the type described above can be arranged in large numbers next to each other upon the base line 1, so that the embroidery machine is equipped with a plurality of such devices. It is also possible to provide embroidery needles alternately with such inventive devices upon the base line, which embroidery needles process other threads.

Conventional drives can be used for driving the pinions 12 and 17 for the hollow shaft 4 and the sleeve 15, and these drives are to be of such a type that they can be offset angularly with respect to each other during the normal operation of the two above-mentioned pinions 12 and 17.

I claim:

1. In a device for embroidery machines for attaching ribbons, braid or the like on an embroidery frame carried by an embroidery base, the device including an axially displaceable rod-like needle carrier with a needle for embroidery or sewing thread and a material pressure foot, the ribbon to be applied being run through the material pressure foot, the material pressure foot being swivelable around the axis of a needle bar, and a shuttle for receiving shuttle thread arranged behind the embroidery base, the improvement comprising the needle bar (7) being received by a hollow shaft (4) which is rotatable with respect to the needle bar (7), the hollow shaft (4) having a front face which faces the embroidery base extending in an embroidery plane (E), the front face defining radially extending grooves (19) arranged diametrically with respect to each other, webs (22) having outer flanks being provided at the rear side of an annular disk-shaped retainer (23) for the material pressure foot (26), the webs (22) engaging in the radially extending groove (19), the retainer (23) being penetrated by the needle of the needle bar (7) and being connected to a lifting mechanism (33) of the material pressure foot (26), at least a front side segment of the hollow shaft (4) being received by a sleeve (15) which is rotatable with respect to the hollow shaft (4), an inside wall of the sleeve (15) including at opposite regions circumferentially extending and sickle-like recesses (20), each recess having a radial width (a), the radial widths of the recesses (20) increasing in opposite circumferential direction, the webs (22) having outer flanks (39), the distance (A) between the outer flanks (39) being somewhat smaller than the sum of the external diameter (D) of the segment of the hollow shaft (4) with the grooves (19) and of the largest radial width (a') of a sickle-like recess (20).

2. Device according to claim 1, wherein an edge of the annular disk-shaped retainer (23) is received by a groove (30) provided at the inside of a support ring (31), the support ring (31) being connected with a carriage (32) which is in operational connection with the lifting mechanism (33) for the material pressure foot (26), wherein a clearance permitting a free motion of the retainer (23) in the plane thereof exists between the groove (30) and the edge of the retainer (23) received by the groove.

3. The device according to claim 1, wherein the webs 22 project in axial direction of the hollow shaft (4) by a larger amount into the grooves (19) than the lifting height of the material pressure foot (26).

4. The device according to claim 1, wherein the material pressure foot (26) includes a leg (28) extending away from the embroidery plane (E), the leg (28) defining a bore (29), the bore (29) opening into a bore (27) of the material pressure foot (26) which receives the needle (10), wherein the ribbon to be applied can be guided through the first mentioned bore (29).

5. The device according to claim 1, wherein the needle (7) defines a longitudinal bore (8) for passing the embroidery thread therethrough.

6. The device according to claim 2, wherein the hollow shaft (4) includes a longitudinally extending groove (5) for passing the ribbon to be applied therethrough.

7. The device according to claim 1, wherein the hollow shaft (4) has an end facing away from the embroidery plane (E), the end of the hollow shaft (4) carrying a bobbin member (40) so as to be freely rotatable with respect to the hollow shaft (4), the ribbon to be applied being coiled around the bobbin member (40).

8. The device according to claim 7, comprising a strip (46, 47) having a plurality of bends arranged on a side of the bobbin member (40) facing the embroidery plane (E) and immediately adjacent the bobbin member, the strip (46, 47) being tightly connected to the hollow shaft (4), the strip (46, 47) serving as a control member (44) for the ribbon to be reeled off the bobbin member (40) and to be fed to the groove (5) of the hollow shaft (4).

9. The device according to claim 1, a drive wheel (12, 17) each being connected to the hollow shaft (4) and the sleeve (15), the drive wheels (12, 17) being in operational connection with a drive, the two drive wheels (12, 17) being rotatable relative to each other.

10. The device according to claim 9, wherein the drive wheels (12, 17) are pinions.

11. The device according to claim 1, wherein the annular disk-shaped retainer (23) has a central cutout (24), wherein the embroidery thread and the ribbon to be applied are feedable through the cutout (24).

12. The device according to claim 1, wherein the embroidery frame carrying the embroidery base and executing pattern movements is capable of carrying out reciprocal movements, the reciprocal movements having the width of a stitch (W), so that the embroidery thread (51) is applied in a zig-zag shape on the ribbon.

* * * * *